US006169525B1

(12) United States Patent
Dziadek et al.

(10) Patent No.: US 6,169,525 B1
(45) Date of Patent: Jan. 2, 2001

(54) HIGH-PERFORMANCE SECTORED ANTENNA SYSTEM USING LOW PROFILE BROADBAND FEED DEVICES

(75) Inventors: Edward F. Dziadek, Mont Vernon; Douglas F. Carey, Nashua, both of NH (US)

(73) Assignee: Spike Technologies, Inc., New York, NY (US)

( * ) Notice: Under 35 U.S.C. 154(b), the term of this patent shall be extended for 0 days.

(21) Appl. No.: 09/151,036

(22) Filed: Sep. 10, 1998

(51) Int. Cl.[7] ..... H01Q 15/08

(52) U.S. Cl. ..... 343/911 R; 343/753; 343/767; 343/792.5; 343/911 L

(58) Field of Search ..... 343/792.5, 767, 343/770, 753, 909, 911 L, 911 R

(56) References Cited

U.S. PATENT DOCUMENTS

| | | | | |
|---|---|---|---|---|
| 2,943,358 | | 7/1960 | Hutchins et al. | 18/58 |
| 3,321,765 | | 5/1967 | Peters et al. | 343/911 |
| 3,470,561 | | 9/1969 | Horst | 343/911 |
| 3,543,271 | * | 11/1970 | Scheel | 343/911 L |
| 3,703,723 | | 11/1972 | Albanese et al. | 343/18 D |
| 3,757,333 | | 9/1973 | Procopio | 343/100 R |
| 3,787,872 | | 1/1974 | Kauffman | 343/911 |
| 4,031,535 | | 6/1977 | Isbister | 343/6.5 R |
| 4,042,935 | * | 8/1977 | Ajioka et al. | 343/795 |
| 4,268,831 | | 5/1981 | Valentino et al. | 343/754 |
| 4,287,519 | * | 9/1981 | Doi | 343/911 L |
| 4,288,795 | * | 9/1981 | Shelton | 343/911 L |
| 4,359,741 | | 11/1982 | Cassel | 343/754 |
| 4,523,198 | | 6/1985 | Clapp | 343/754 |
| 4,531,129 | | 7/1985 | Bonebright et al. | 343/754 |
| 4,626,858 | | 12/1986 | Copeland | 342/374 |
| 4,723,123 | | 2/1988 | Marlow et al. | 342/6 |
| 4,730,310 | | 3/1988 | Acampora et al. | 370/95 |
| 4,755,820 | | 7/1988 | Backhouse et al. | 343/700 MS |
| 4,806,932 | | 2/1989 | Bechtel | 342/33 |
| 4,819,227 | | 4/1989 | Rosen | 370/75 |
| 4,931,808 | * | 6/1990 | Lalezari et al. | 343/753 |
| 5,047,776 | | 9/1991 | Baller | 342/52 |
| 5,084,711 | * | 1/1992 | Moss et al. | 343/911 L |
| 5,115,248 | | 5/1992 | Roederer | 342/373 |
| 5,260,968 | | 11/1993 | Gardner et al. | 375/1 |
| 5,485,631 | | 1/1996 | Bruckert | 455/33.3 |
| 5,548,294 | | 8/1996 | Sturza | 342/372 |
| 5,703,603 | | 12/1997 | Korzhenkov et al. | 343/753 |
| 5,748,151 | | 5/1998 | Kingston et al. | 343/753 |

* cited by examiner

*Primary Examiner*—Tan Ho
(74) *Attorney, Agent, or Firm*—Wolf, Greenfield & Sacks, P.C.

(57) ABSTRACT

A sectored antenna system has one or more dielectric lenses, each having a surface and two or more low profile antenna feed devices. At least one of the feed devices radiate signals into said lens that emerge as separate directional beams, and/or the lenses receive incoming signals from different directions and focus them onto different antenna feed devices. The feed devices of the sectored antenna system are low-profile broadband feed devices, such as log periodic dipole arrays or tapered notch antennas. Special design guidelines are given for their use with a lens. In addition, a method to reduce the cut off frequency of the tapered notch antenna is shown.

7 Claims, 7 Drawing Sheets

HIGH-PERFORMANCE SECTORED ANTENNA SYSTEM USING LOW PROFILE BROADBAND FEED DEVICES

FIELD OF THE INVENTION

This invention relates generally to the field of wireless communications, and more particularly to high-performance sectored antenna systems using low profile broadband feed devices.

BACKGROUND OF THE INVENTION

A high performance sectored antenna system is discussed generally in U.S. patent application Ser. No. 08/677,413 now abandoned entitled Focused Narrow Beam Communication System, incorporated herein by reference. Such a sectored antenna system utilizes a lens device with multiple focal points that serve as ports for the RF signals associated with each respective sector. Feed devices are typically mounted in close proximity to each desired focal point of the lens and the design of such feed devices is crucial to the performance of the sectored antenna system.

Performance parameters for a sectored antenna system include gain, side lobe and back lobe performance, and isolation among sectors. Feed device design affects all three of these parameters. It is desirable to have high gain in the desired direction of each sector, with low side lobe and back lobe levels to minimize the amount of radiation into other sectors. These objectives can be accomplished by increasing the size of the sectored antenna system, but it is also desirable to keep the antenna system as small as possible. If such a sectored antenna system is to cover more than 90 degrees, it is likely that some feed devices will partially block the signals of other feeds, reducing the effective gain of those sectors of the antenna system. Such blockage should be reduced, but should also minimize detrimental effect of other design parameters.

In order to reduce blockage that results in high side lobes, small feed devices are often used. Unfortunately, small feeds result in broad primary patterns, which in turn reduce aperture taper and result in high side lobes. Until recently, most work has involved waveguides as the primary feed devices for lens antennas. Some recent work has involved microstrip patch feeds and has had some success in lowering overall side lobe levels. These microstrip patch feed devices have the advantage of a constant phase center over their operating band but have the disadvantage of a large structure. Microstrip patch antenna feeds can be made smaller through the use of a higher dielectric constant substrate material, but they have relatively narrow bandwidth and typically require separate transmit and receive feeds, thereby doubling the size.

Ordinarily, broadband feed devices would not be used with lens antennas in a high performance sectored antenna system because of the nature of their operation. Among other drawbacks, such feed device phase centers move over frequency, making broadband operation difficult. As discussed in *Antenna Theory Analysis and Design* by Constantine Balanis on p. 556 and typically accepted in the field of high performance sectored antenna systems, "The movement of the active region of the antenna, and its associated phase center, is an undesirable characteristic in the design of feeds for reflector and lens antennas." The present invention successfully utilizes low profile broadband feed devices in a lens-based sectored antenna system, resulting in higher performance with lower back lobes and side lobes.

SUMMARY OF THE INVENTION

An object of this invention is to create a high-performance, yet compact sectored antenna system that reduces side lobe and back lobe radiation using low profile broadband feed devices.

A related object of this invention is to create an efficient method of feeding signals into and out of a dielectric lens device.

Another object of this invention is to reduce coupling among sectors in a sectored antenna system.

Yet another object of this invention is to create a sectored antenna system for broadband operation across a wide range of frequencies.

Another object of this invention is to create a sectored antenna system capable of supporting a high capacity communications system.

In accordance with a preferred embodiment of the invention, a sectored antenna system comprises one or more dielectric lenses, each having a surface and one or more low profile broadband feed devices next to the lens surface In a preferred embodiment, such feed devices may be log periodic dipole arrays and/or notch antenna feeds. Other low profile broadband feed devices could also be used. The feed devices radiate signals into the lens that emerge as separate directional beams in the transit operating mode, or the lenses receive incoming signals from different directions and focus them onto different antenna feed devices in the receive operating mode, or a combination thereof. In the preferred embodiment of this invention, a Luneberg lens is employed whose focal point by design or construction is on or outside the surface of the lens, but other types of lenses can also be used. The low profile broadband feed devices minimize blockage and scattering to improve overall side lobe level performance.

Other objects and advantages of the present invention will become apparent from the following description, taken in connection with the accompanying drawings, wherein, by way of illustration and example, embodiments of the present invention are disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENT

Detailed descriptions of preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The following discussion depicts operation of the preferred embodiments in the transmission mode. The same issues apply in the reception mode, and can be understood by simply reversing the direction of the beams depicted in the various figures.

Figure 1:
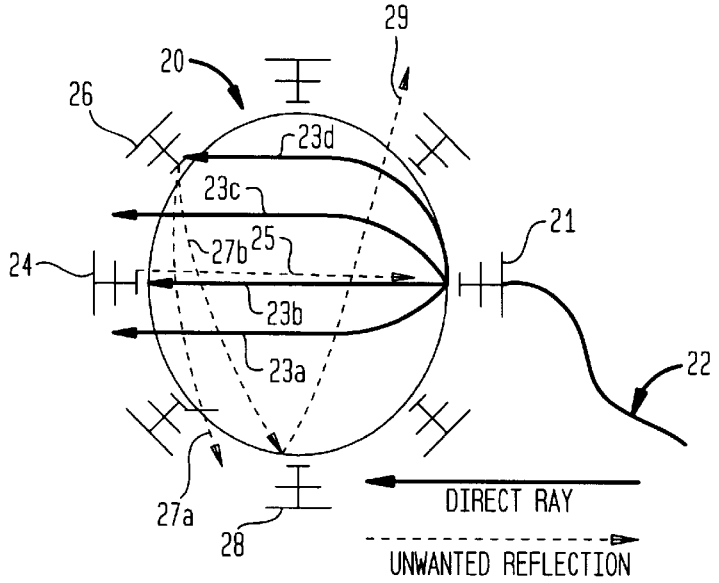
FIG. 1 is a schematic view showing desired ray and reflected rays that contribute to side lobe levels.
Figure 2:
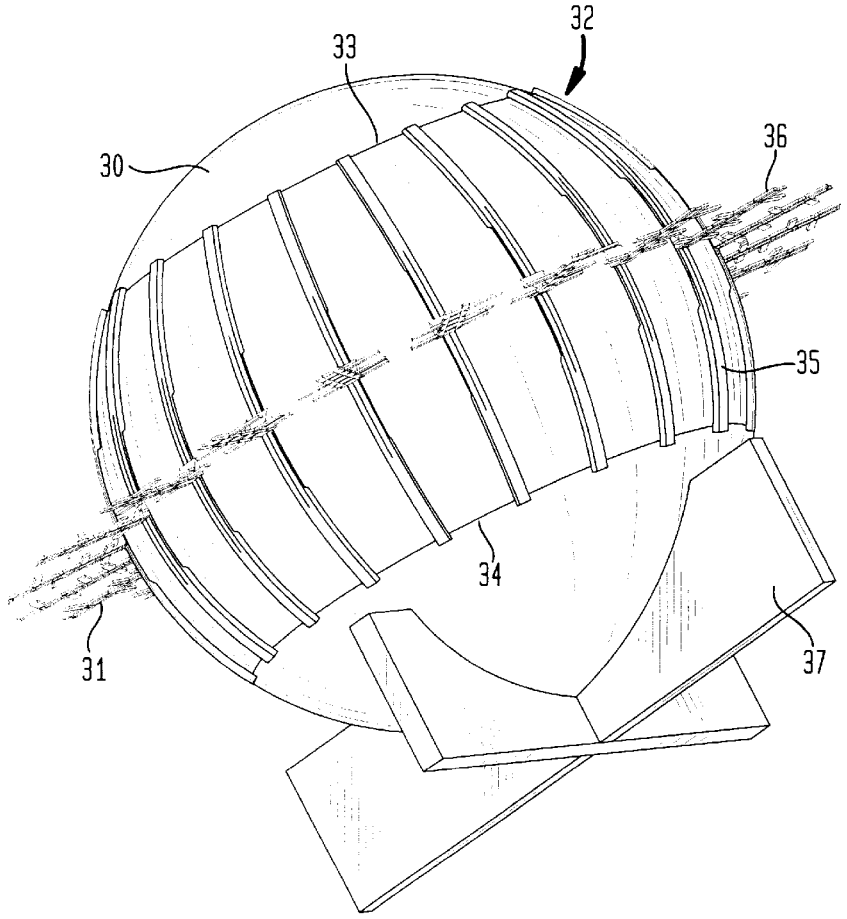
FIG. 2 is a preferred embodiment showing log periodic dipole array feed devices mounted to a lens according to the present invention.

FIGS. 1 and 2 show a schematic diagram depicting an embodiment of the present invention, including a dielectric lens 20 fed by a feed 21 such as a log periodic dipole array, connected to signal cable 22. The lens focuses the signal illustrated at 23*a*–23*d* from feed device 21, creating a pattern similar to that formed by a parabolic dish antenna. For a sectored antenna system, multiple feeds are used, so that the system mimics multiple parabolic dishes. The bold lines 23*a*–23*d* depict the desired signal passing through the lens from feed 21. A portion of this desired signal will not only be blocked by feed 24 but it will hit feed 24 and will be reflected back through the lens, emerging from the other side as a back lobe 25. The entire lens participates in the refraction of the signal. For example, signal 23*d* from feed 21 hits feed 26, causing a reflection 27*a*–27*b* that mostly travels back into the lens, emerging as side lobe radiation. Again, signal 27*b* can hit feed 28, causing yet another reflection 29, and therefore additional side lobe energy.

The amount of energy that is blocked by feed 24 and reflected by feed 24 is proportional to its size or cross sectional area. The feed cross sectional area can be divided into two terms: 1) the antenna mode return; and 2) the structural mode return. The antenna mode can be suppressed by having the appropriate match load as understood in the art. The structural mode is reduced with the appropriate choice and design of the feed device.

FIG. 2 shows a preferred embodiment of the present invention having a dielectric lens 30. The illustrated embodiment uses a step approximation to a Luneberg lens and has its focal point outside of the lens surface, though other lenses could also be used. Attached to the lens is a collar 32 made of Delrin (other non-metallic materials can also be used) to position the feed devices in both azimuth and elevation, and to adjust radial and rotational position. Collar 32 is described in more detail in U.S. application Ser. No. 08/677,413, incorporated herein by reference. Other means can also be used to position the feed devices.

In accordance with an important feature of the invention, the feed devices 31 are wire log periodic dipole arrays (LPDA). Printed circuit or other versions of the LPDA could also be used and would be obvious in design to those of skill in the art upon the description below. The lens is attached to a lens support 37 which in turn is attached to a mounting platform or other suitable device. The support 37 is constructed of two perpendicular sections joined together at their midpoint in order to form an x. Although the sections are constructed of polystyrene foam, other non-metallic materials can also be used. Each sections width is sufficient to support the load of the lens. The profile of the top of the section is made to match the contour of the lens and as not to interfere with the movement of the collar 32, where the bottom profile is made to match the contour of the mounting platform. The height of the support is chosen to minimize the effect on the mounting platform on the performance of the system.

Twenty-two LPDA feeds 31 (a greater or lesser number of feeds can be used) are shown mounted perpendicular to the lens surface by collar 32 used for mounting the feeds 31 near the lens 30. Feeds 31 are aligned in a horizontal fashion to avoid "fins" that would create additional unwanted blockage.

Figure 6:
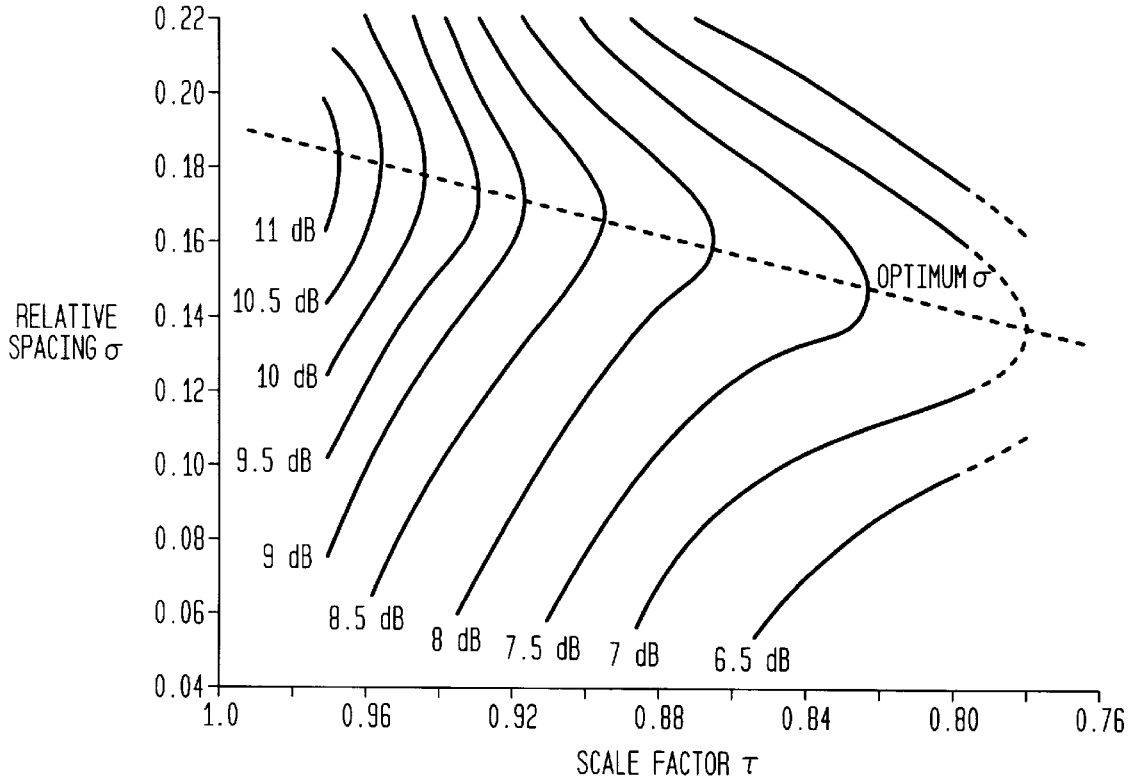
FIG. 6 (PRIOR ART)
FIG. 6 illustrates conventional design curves for log periodic dipole array feed devices.

Traditionally, the design of an LPDA begins with specification of the desired gain. Traditionally, optimum relative spacing a and scale factor $\tau$ are determined from published curves such as the one reproduced for reference in FIG. 6. The length of the elements is then normally determined by the upper and lower frequency of operation. Several elements are added to each end to maintain desired pattern and gain over frequency. However, these design parameters are inadequate for high performance sectored antenna systems using lens antennas as they lead to feed designs with large active regions and feeds whose active regions vary considerably with frequency.

Figure 3:
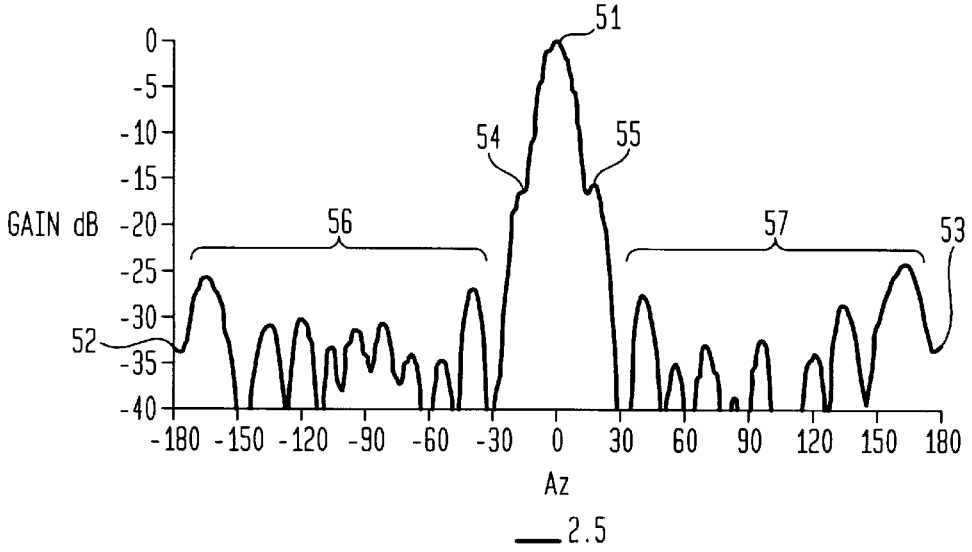
FIG. 3 illustrates radiation patterns of a preferred embodiment of the invention with log periodic dipole array feeds according to the present invention.
Figure 4:
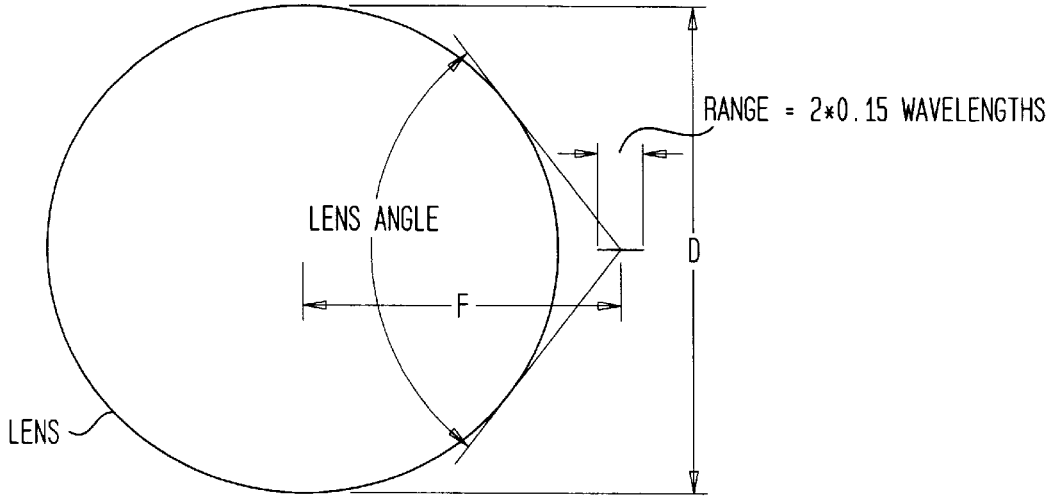
FIG. 4 shows the geometry of a generic lens with diameter D, focal length F, resultant subtended lens angle, and acceptable range for focal point.
Figure 5:
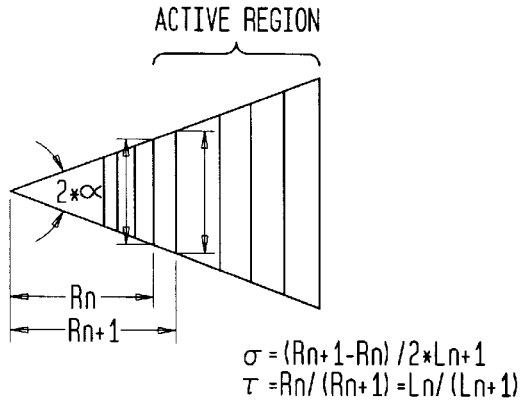
FIG. 5 shows the design parameters of a log periodic dipole array.
Figure 7:
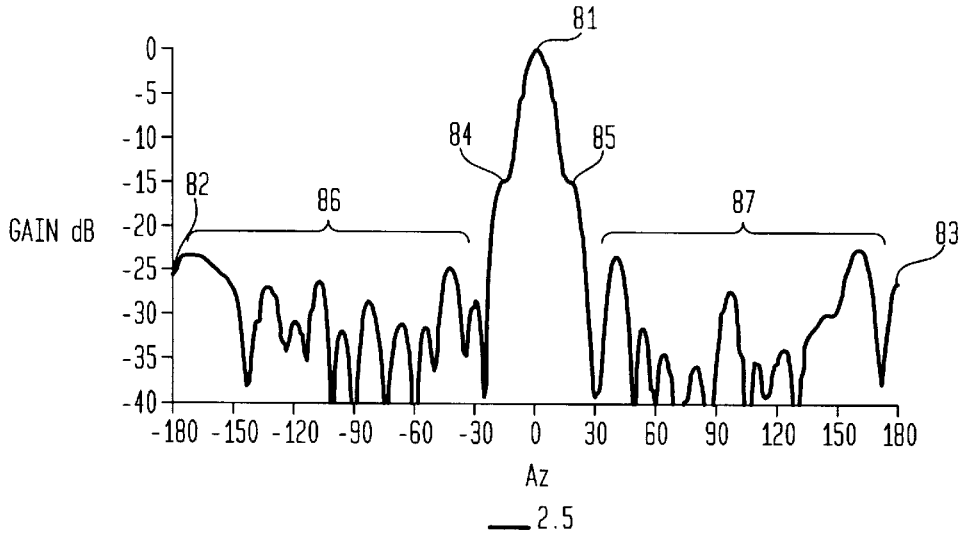
FIG. 7 depicts an example of patterns with log periodic dipole array feeds outside of the design guidelines of the present invention.

In accordance with another important feature of the present invention, in the LPDA feed, the largest element must be no larger than $\lambda/2$, where $\lambda$ is the wavelength of the lowest frequency. This ensures that the reflective area of any feed blocking the primary signal path is minimal or more specifically that the structural mode of the antenna is minimized by eliminating those elements which contribute the most, i.e. the longest non-radiating elements. Elements larger than $\lambda/2$ elements contribute significantly to back lobe and side lobe levels. In this regard compare FIG. 3 showing the radiation pattern for elements within the preferred design parameters to FIG. 7 showing the radiation pattern for elements outside the preferred design patterns, discussed in more detail below. In addition to limiting the maximum size of the LPDA for a given frequency range, the apex half angle $\alpha$, as shown in FIG. 5, must be made large enough, by minimizing $\sigma$ and maximizing $\tau$, to constrain the width of the active region within an acceptable range of the focal point. Although the actual range will depend on application, a value of +/− 0.15 $\lambda$ is used for reflector antennas to yield an acceptable loss in gain of less than 0.2 dB as discussed in Antenna Engineering Handbook, Third Ed. R. C. Johnson pp. 30-12 to 30-17. FIG. 4 shows the geometry of a lens with diameter D and focal length F and also indicates the acceptable focal range for a lens antenna system.

The bandwidth of the active region ($B_{ar}$), defined by $B_{ar}=1.1+7.7*(1-\tau)\hat{}2 * \cot(\alpha)$, and the associated width must be contained within +/− 0.15 $\lambda$ of the focal point for all frequencies of operation. In the preferred embodiment, a value for $\sigma$ of 0.158 and a value for $\tau$ of 0.862 with five elements were used to maintain the active region within the acceptable range of the focal point. Together, these parameters affect the level of desired-to-undesired signals (D/U)

throughout the antenna system. It is desirable to maximize the D/U ratio so that more sophisticated digital modulation techniques can be used, resulting in broadband transmission with increased overall capacity. FIG. 7 shows patterns of a lens with LPDA feeds whose active regions exceed the acceptable range. The back lobe performance, regions 82 and 83 of FIG. 7 is 8 dB higher when compared to FIG. 3 regions 52 and 53. Similarly, side lobe regions 86 and 87 of FIG. 7 are 3 dB higher compared to FIG. 3 regions 56 and 57.

In accordance with another feature of an embodiment of the present invention, the feed devices are aligned in a horizontal fashion, thereby minimizing the blockage to the other feed devices. Feed devices arranged in a vertical fashion would have a "fan" shape when viewed from an angle, resulting in greater blockage and poorer performance. The present invention can certainly operate without having the feed devices aligned horizontally, but by aligning them horizontally performance is enhanced.

Figure 8:
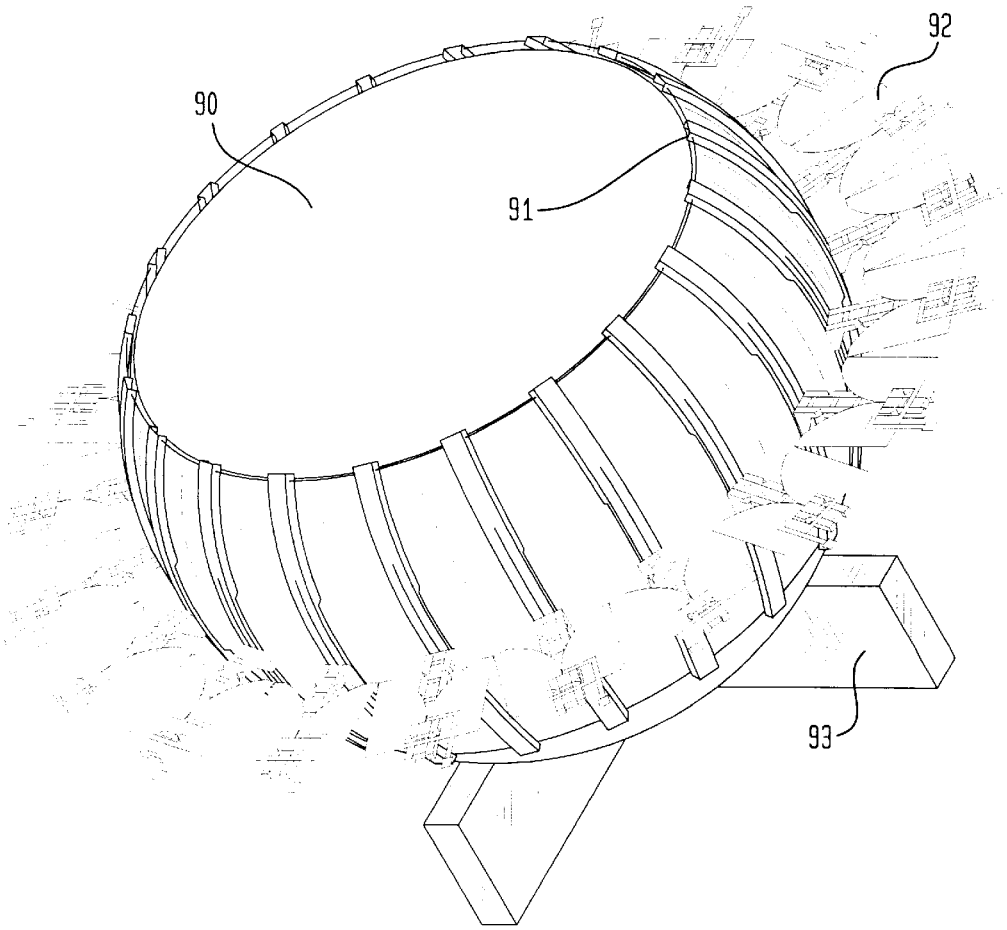
FIG. 8 shows another preferred embodiment showing notch feed devices mounted to a lens according to the present invention.

FIG. 8 shows another preferred embodiment of the present invention. In this embodiment, the low profile broadband feed devices 92 are metal notch antennas. Printed circuit or other versions of the notch could also be used and would be obvious in design to those of skill in the art upon the description below. The lens is attached to a lens support 93, which in turn is attached to a mounting platform or other suitable device.

Turning now to FIG. 8 in more detail, a stepped approximation to a Luneberg lens with focal point outside of the lens surface 90 is shown. Twenty-two notch feeds 92 (a greater or lesser number of feeds can be used) are shown mounted perpendicular to the lens surface by collar 91 used for mounting the feeds 92 to the lens 90.

Figure 9:
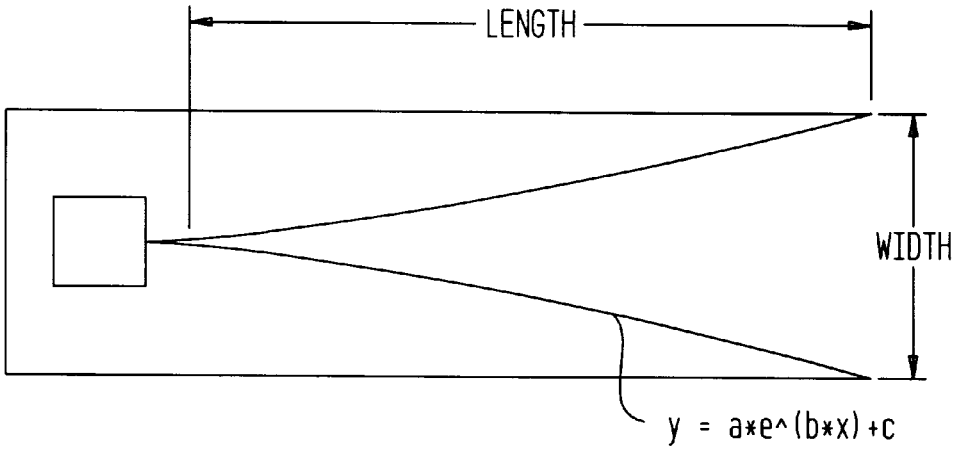
FIG. 9 (PRIOR ART)
FIG. 9 shows conventional design parameters of a tapered notch antenna feed device.

FIG. 9 shows the configuration of a general design showing the width, length, and equation of the tapered section of a notch antenna. Although shown is an exponential taper, other types of tapers can be used. Typical operation of the notch involves excitation of the slot, usually by a coax cable with the outer conductor shorted to one side of the slot, and center conductor shorted to the other side of the slot. A stub is used on one end to ensure propagation in one direction and to aid in matching the junction. Other techniques of exciting the notch are known and can be found in the literature such as *IEEE Transactions on Microwave Theory and Techniques* vol. MTT-17 no.10, October 1969, pp. 768–778, *IEEE Transactions on Microwave Theory and Techniques* vol. 36 no. 8, August 1988, pp. 1272–1282. The wave then travels down the slot to a point at which the width of the slot is approximately one half wavelength ($\lambda/2$) at the frequency of operation. At this point, the wave transitions from being tightly bound to the structure of the slot and becomes loosely bound and tends to radiate. The rate at which this radiation occurs is dependent on the taper of the slot.

Movement of the phase center of the notch feed with frequency, as in the LPDA, would normally exclude this element for use with a lens antenna but through control of the rate of the taper, the phase center can be constrained within the focal point of the lens. Traditional notch design guidelines suggest a 5:1 length-to-width ratio for efficient operation, and dictate that the lower frequency limit of operation is where the width is equal to one half wavelength ($\lambda/2$). The equation of the form $y=a^* e^{(b^*x)}+c$ represents the taper of the slot, where w=width of the start of slot and W=width of the end of the slot, or equal to half wavelength at the low end, and L=the length of the tapered region. Rewritten $c=w/2-a$; $b=\ln((W-c)/a)/l$ such that for a fixed size (i.e. length and width) all other parameters can be written in terms of a, the expansion factor.

Figure 10:
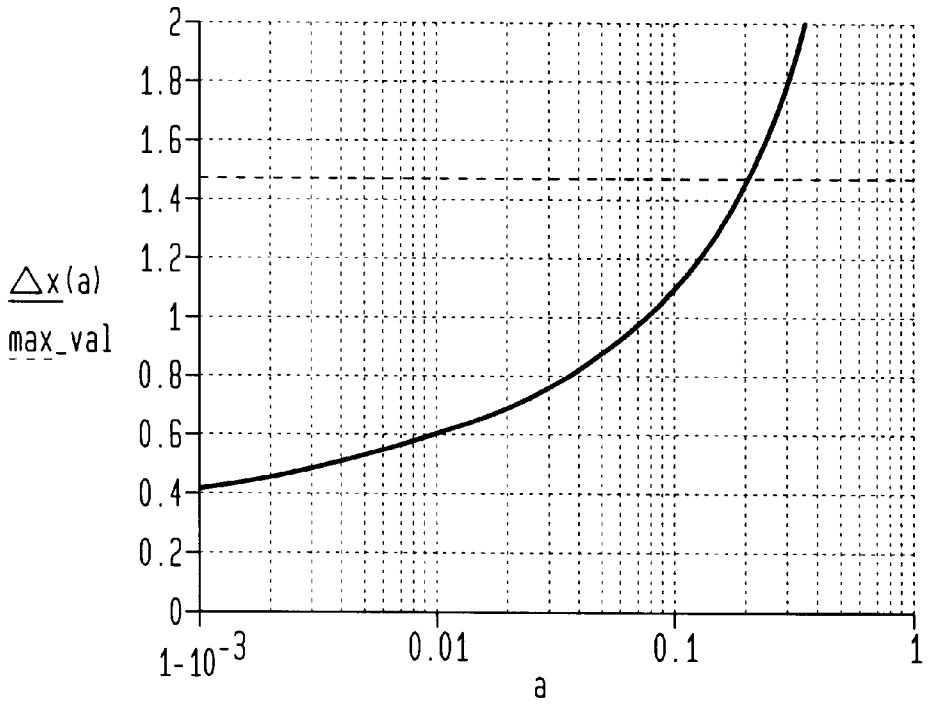
FIG. 10 shows the desired values for a tapered notch of 7.5 inches width, 3.0 inches length, and bandwidth of 66%.

By choosing a, the taper or where the energy radiates from and therefore the movement of the phase center of the antenna in a similar many as described previously with the LPDA's may be controlled. Using this analytical process with traditional suggested notch guidelines of 5:1 length-to-width ratio results in poor performance. While the equations are still helpful, much different values must be used for good performance. By determining the points at which the upper and lower frequency limits radiate from, and setting a maximum separation between them, the travel of the phase center to an acceptable distance (as previously described with LPDA's) through the selection of the expansion factor a may be limited. FIG. 10 shows allowable values of a for length of 7.5 inches, width of 3 inches and bandwidth of 66%, and a length-to-width ratio of 2.5:1; this deviates significantly from traditional guidelines.

Figure 11:
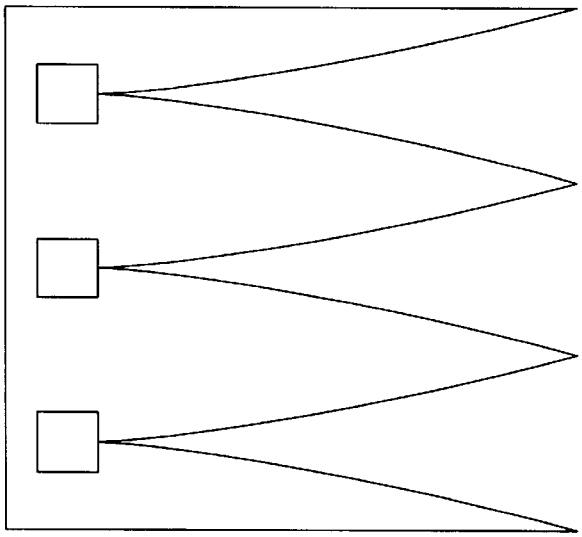
FIG. 11 shows joining of feeds to lower the cut off frequency of the notch antenna.
Figure 12:
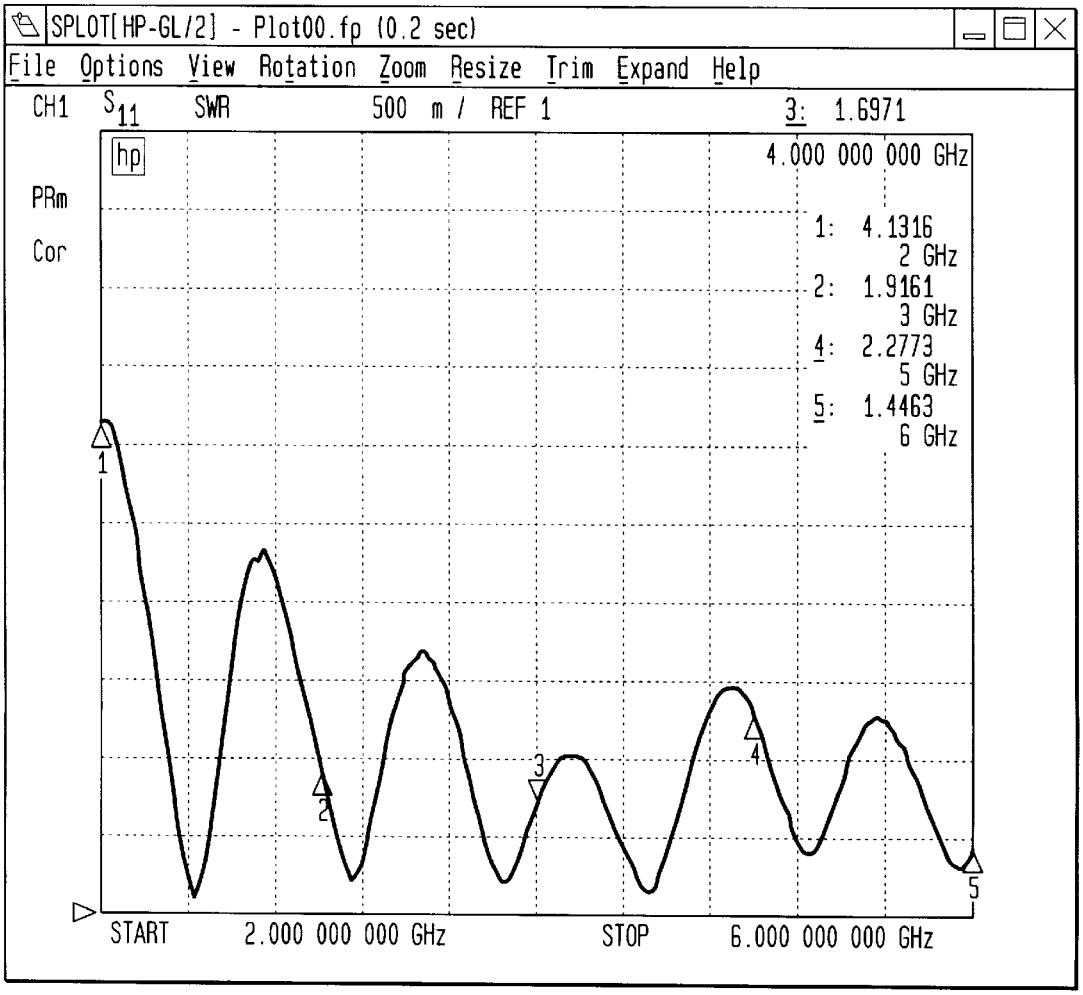
FIG. 12 shows the voltage standing wave ratio (VSWR) of a single tapered notch antenna.
Figure 13:
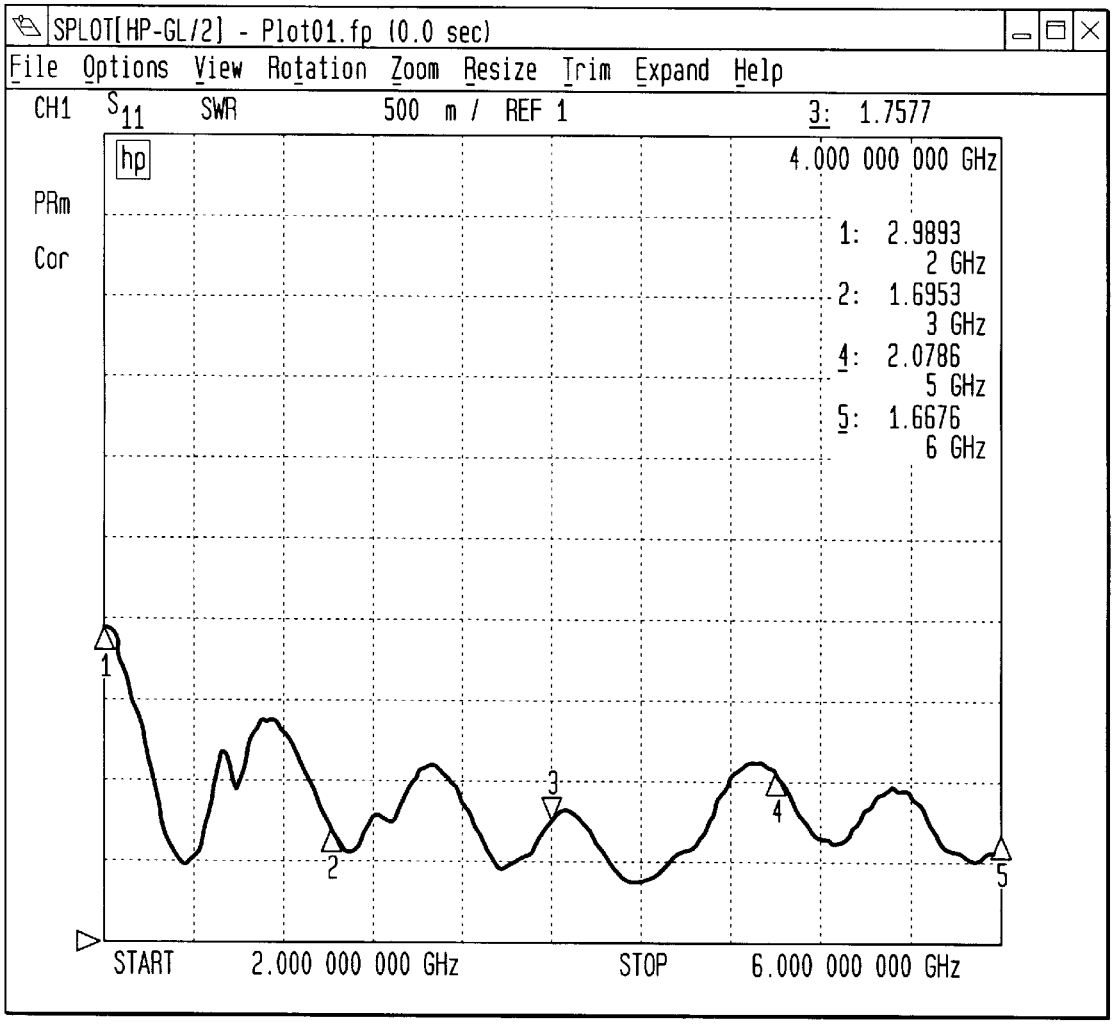
FIG. 13 shows the VSWR of tapered notch antennas joined together.

Another feature of the invention is that by joining two or more notch feeds at the ends, the minimum frequency of operation can be lowered. FIG. 11 shows how the feeds are joined and FIG. 12 shows the voltage standing wave ratio (VSWR)—a measure of the reflected energy—of a single element. FIG. 13 shows the improvement in VSWR of the joined elements. Although the elements shown are shorted together other means such are resistive or capacitive coupling can be used as well as others that would be obvious to one skilled in the art. By adding an additional element to either side, the effective width of the element is increased, and the cut off frequency lowered without significant change in the radiation pattern. This can lower the cut off frequency and can enable closer spacing of the feed elements for a given frequency, thereby increasing the amount of frequency reuse in the sectored antenna system. Also, by having the feeds closer, the overlap of the sectors can be increased to increase the overall signal-to-noise ratio of the sector. As in the previous embodiment, the feed devices are aligned in a horizontal fashion for improved performance.

As mentioned above, the entire side lobe, back lobe and other issues described herein apply to an antenna system in transmission mode. The present invention also works in receive mode, and delivers all of the benefits that occur in transmit mode. In summary, the signals from the various sectors arrive at the lens device from different directions. The lens device focuses the signals onto the respective antenna fed devices. This is the reverse of operation in transmit mode.

While the invention has been described in connection with preferred embodiments, it will be understood that it is not intended to be limited to the particular embodiments shown but intended, on the contrary, to cover the various alternative and equivalent constructions included within the spirit and scope of the appended claims.

We claim:

1. A high performance sectored antenna system for use in a wireless communication system comprising:

an antenna lens having an outer surface; and a plurality of feed devices connected such that the feed devices surround at least a portion of the outer surface of the lens, wherein a first feed device is located adjacent a first side of the lens and a second feed device is located adjacent a second side of the lens, and wherein the first feed device provides a first signal to the lens that exits the lens from the second side of the lens and the second feed device provides a second signal to the lens that exits from the first side of the lens;

wherein each feed device has a physical structure and is arranged with respect to the lens outer surface so as to minimize a surface area of the feed device that faces the lens outer surface to reduce back lobe and side lobe radiation caused by the first feed device on the second signal and by the second feed device on the first signal.

2. The sectored antenna system as claimed in claim 1 wherein at least one feed device includes a log periodic dipole array.

3. The sectored antenna system as claimed in claim 2 wherein a maximum size of a longest element of each log periodic dipole array feed device is less than or equal to $\lambda/2$ at a lowest frequency of operation.

4. The sectored antenna system as claimed in claim 1 wherein at least one feed device includes a tapered notch antenna.

5. The sectored antenna system as claimed in claim 4 wherein each tapered notch antenna is joined to an adjacent element.

6. The sectored antenna system as claimed in claim 1 wherein each feed device includes a low profile broadband feed device that has an active region constrained within the focal point of the lens.

7. The sectored antenna system as claimed in claim 1 wherein the feed devices are aligned to minimize their physical profile in an axis tangential to the lens outer surface and perpendicular to a path over which the feed devices are mounted.

* * * * *